US009456650B1

(12) United States Patent
Boyce

(10) Patent No.: US 9,456,650 B1
(45) Date of Patent: Oct. 4, 2016

(54) SWEAT CONTROL DEVICE

(71) Applicant: Stephen V. Boyce, Cumberland, RI (US)

(72) Inventor: Stephen V. Boyce, Cumberland, RI (US)

( * ) Notice: Subject to any disclaimer, the term of this patent is extended or adjusted under 35 U.S.C. 154(b) by 0 days.

(21) Appl. No.: 14/872,431

(22) Filed: Oct. 1, 2015

Related U.S. Application Data

(60) Provisional application No. 62/126,399, filed on Feb. 27, 2015.

(51) Int. Cl.
*A42C 5/00* (2006.01)
*A42C 5/02* (2006.01)

(52) U.S. Cl.
CPC ..... *A42C 5/02* (2013.01)

(58) Field of Classification Search
CPC ..... A41D 20/00; A42B 1/041; A42C 5/02
USPC ..... 2/170, 171, 181, DIG. 11, 918
See application file for complete search history.

(56) References Cited

U.S. PATENT DOCUMENTS

| | | | | |
|---|---|---|---|---|
| 2,016,210 | A | 10/1935 | Mann | |
| 2,106,075 | A | 1/1938 | Tabley | |
| 2,160,567 | A | 5/1939 | Sterne | |
| 2,320,782 | A | 6/1943 | Larsen | |
| 4,393,519 | A | 7/1983 | Nicastro | |
| 4,394,782 | A | 7/1983 | Wasson | |
| 4,502,156 | A | 3/1985 | Wishman | |
| 4,521,922 | A | 6/1985 | Mitchell et al. | |
| 4,547,903 | A | 10/1985 | Brown et al. | |
| 4,626,247 | A | 12/1986 | Frankel | |
| 4,638,512 | A | 1/1987 | Frankel | |
| 4,698,852 | A * | 10/1987 | Romero | A42B 3/00 2/171 |
| 4,742,581 | A | 5/1988 | Rosenthal | |
| 4,856,116 | A | 8/1989 | Sullivan | |
| 4,941,210 | A | 7/1990 | Konucik | |
| 5,025,504 | A | 6/1991 | Benston et al. | |
| 5,033,122 | A * | 7/1991 | Smith | A41D 20/00 2/170 |
| 5,146,630 | A | 9/1992 | Richard | |
| 5,175,887 | A | 1/1993 | Kim | |
| 5,331,686 | A | 7/1994 | Marshall | |

(Continued)

FOREIGN PATENT DOCUMENTS

| | | | |
|---|---|---|---|
| CN | 203015942 | U | 6/2013 |
| CN | 203017749 | U | 6/2013 |
| WO | 2005025350 | A1 | 3/2005 |

OTHER PUBLICATIONS

Switchback, LLC, http://www.haloheadband.com, Aug. 18, 2015 (date printed).

*Primary Examiner* — Tejash Patel
(74) *Attorney, Agent, or Firm* — Buchanan Law, LLC; Karen A. Buchanan

(57) ABSTRACT

A sweat control device comprising a first strip of material shaped as an elongated rectangle and configured to fit around at least a portion of the head of a wearer or at least a portion of the inside rim of a piece of headgear, the first strip of material comprising a first side section, a front middle section, a back middle section, and a second side section; a second strip of material shaped as an elongated rectangle and attached to at least a portion of the front middle section and at least a portion of the back middle section of the first strip of material; the first strip of material comprising moisture-conductive material for attracting and controlling moisture; and the second strip of material comprising moisture-resistant material for containing and channeling the moisture.

16 Claims, 4 Drawing Sheets

(56) References Cited

U.S. PATENT DOCUMENTS

| | | | | |
|---|---|---|---|---|
| 5,553,326 | A * | 9/1996 | Moore | A41D 20/00 2/181 |
| 5,740,556 | A | 4/1998 | Brown | |
| 5,745,921 | A | 5/1998 | Mitchell et al. | |
| 5,781,932 | A | 7/1998 | Brown | |
| 5,915,532 | A * | 6/1999 | Williams | A41D 20/00 2/171 |
| 6,026,518 | A | 2/2000 | Brown | |
| 6,108,818 | A | 8/2000 | Eisenberg | |
| 6,205,590 | B1 | 3/2001 | Gorman | |
| 6,353,936 | B2 | 3/2002 | Flatt | |
| 6,564,390 | B2 | 5/2003 | Vernon | |
| 6,567,991 | B1 | 5/2003 | Holslag et al. | |
| 6,584,984 | B2 | 7/2003 | Kelly | |
| 6,971,122 | B2 | 12/2005 | Sanchez | |
| 6,978,487 | B2 * | 12/2005 | Abraham | A42B 3/10 2/181 |
| 7,043,761 | B2 | 5/2006 | Epling | |
| 7,213,271 | B1 | 5/2007 | Bielefeld | |
| 7,398,559 | B2 | 7/2008 | Flatt | |
| 7,497,097 | B2 | 3/2009 | Herr | |
| 7,681,252 | B1 * | 3/2010 | Petry | A42C 5/02 2/174 |
| 8,296,866 | B2 | 10/2012 | Kelly | |
| 8,850,616 | B1 | 10/2014 | Hoover et al. | |
| 2011/0016610 | A1 | 1/2011 | Wieder | |
| 2012/0216332 | A1 | 8/2012 | Wooley | |
| 2013/0185843 | A1 | 7/2013 | Rahm | |
| 2014/0259286 | A1 | 9/2014 | Boyle | |
| 2014/0289932 | A1 | 10/2014 | Shapiro | |

* cited by examiner

SWEAT CONTROL DEVICE

CROSS-REFERENCE TO RELATED APPLICATIONS

This application claims the benefit of U.S. Provisional Application 62/126,399 filed Feb. 27, 2015, the disclosure of which, in its entirety, is incorporated herein by reference.

BACKGROUND OF THE INVENTION

1. Field of the Invention

The present invention relates to head apparel and, more particularly, to bands worn around the head and bands that line the inside rim of headgear.

2. Description of Related Art

Sweating, or perspiring, is the human body's mechanism for keeping us cool and preventing us from overheating in a warm environment or during exercise or exertion. Typically, the human body produces about a quart of sweat per day, most of which evaporates as soon as it is produced. However, when engaged in vigorous exercise, or physical exertion in high temperatures and/or high humidity, the human body produces more sweat—up to 10 gallons in a day—than can be evaporate into the atmosphere.

As this excess sweat builds up on a person's scalp, it connects with the sweat building up on the person's forehead and flows down into the person's eyes and mouth. Besides hampering the person's vision (and potentially putting the person at risk), head sweat may contain chemicals from haircare or skincare products—such as hair spray, make-up, sunscreen and insect repellant—that will further irritate the person's eyes and, if swallowed, endanger the person's health.

The prior art attempts to solve these issues with sweatbands that absorb the excess moisture, sweatbands made from non-absorbent material that divert the excess moisture, and sweatbands that aid in the evaporation of excess moisture by wicking the excess moisture from the internals layers of a sweat band to the external layers of a sweat band.

BRIEF SUMMARY OF THE INVENTION

In one embodiment of the invention, a sweat control device comprises a first strip of material shaped as an elongated rectangle and configured to fit around at least a portion of the head of a wearer or at least a portion of the inside rim of a piece of headgear, the first strip of material comprising a first side section, a lower front middle section, a lower back middle section, and a second side section; a second strip of material shaped as an elongated rectangle and attached to at least a portion of the lower front middle section and at least a portion of the lower back middle section of the first strip of material; the first strip of material comprising moisture-conductive material for attracting and controlling moisture; and the second strip of material comprising moisture-resistant material for containing and channeling the moisture.

In an alternate embodiment, at least a portion of the second strip of material attaches to at least a portion of the front middle section of the first strip of material, at least a portion of the back middle section of the first strip of material, or at least a portion of both middle sections of the first strip of material using a process for coating textiles.

In another embodiment of the invention, a sweat control device comprises a first strip of material shaped as an elongated rectangle and configured to fit around at least a portion of the head of a wearer or at least a portion of the inside rim of a piece of headgear, the first strip of material comprising a first side section, a lower front middle section, a lower back middle section, an upper front middle section, an upper back middle section, and a second side section; a second strip of material shaped as an elongated rectangle and attached to at least a portion of the lower front middle section and at least a portion of the lower back middle section of the first strip of material; a third strip of material shaped as an elongated rectangle and attached to at least a portion of the upper front middle section and at least a portion of the upper back middle section of the first strip of material; the first strip of material comprising moisture-conductive material for attracting and controlling moisture; and the second strip of material comprising moisture-resistant material for containing and channeling the moisture.

In an alternate embodiment, the second strip of material, the third strip of material, or both strips of material attach to at least a portion of the middle section of the first strip of material using a process for coating textiles.

In a further embodiment of the invention, a sweat control device comprises a first strip of material shaped as an elongated rectangle and configured to fit around at least a portion of the head of a wearer or at least a portion of the inside rim of a piece of headgear, the first strip of material comprising a single-ply of material and having a first side section, a front middle section, a back middle section, and a second side section; a second strip of material shaped as an elongated rectangle and attached to at least a portion of the front middle section and at least a portion of the back middle section of the first strip of material using a process for coating textiles; the first strip of material comprising moisture-conductive material for attracting and controlling moisture; and the second strip of material comprising moisture-resistant material for containing and channeling the moisture.

In further alternate embodiments of each of the described inventions, the second strip of material and/or the third strip of material may comprise at least one piece of material. Further, the height of the second strip of material and/or the height of the third strip of material attached to at least a portion of the front middle section of the first strip of material may be shorter than, the same as, or taller than, respectively, the height of the second strip of material and/or third strip of material attached to at least a portion of the back middle section of the first strip of material.

BRIEF DESCRIPTION OF THE SEVERAL VIEWS OF THE DRAWING

The foregoing features of the invention will be more readily understood by reference to the following detailed description, taken with reference to the accompanying drawings, in which.

DETAILED DESCRIPTION OF THE INVENTION

The sweat control device described herein attracts and controls the movement of sweat from a person's scalp and forehead toward the back of the person's ears, or toward the back of the person's scalp. It may be configured as a stand-alone headband or it may be configured to line the inside rim of headgear, such as a hat or a helmet.

Figure 1A:
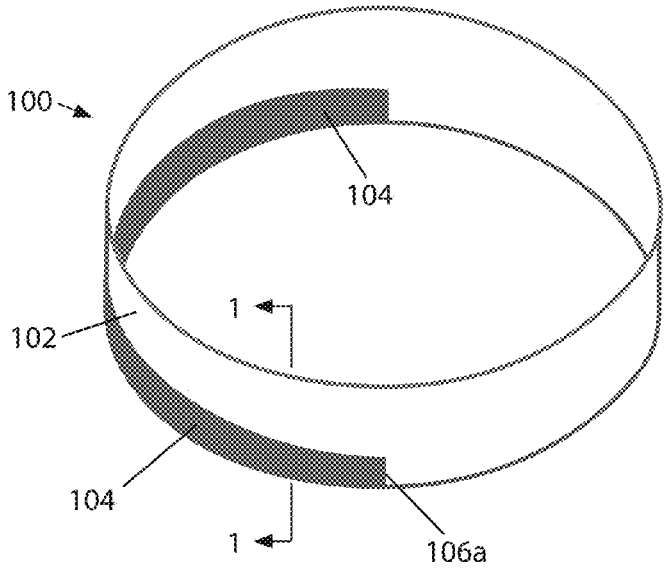
FIG. 1*a* is a top-down view of a sweat control device, in accordance with one embodiment of the invention.

FIG. 1*a* is a top-down view of a sweat control device, detached from any headgear, in accordance with one embodiment of the invention. In this embodiment, sweat control device 100 comprises moisture-conductive material 102, which is treated—with moisture-resistant coating 104—along a portion of the back surface and a portion of the front surface of its bottom edge. In this embodiment, sweat control device 100 is reversible, that is, it may be worn "inside out" or "outside in."

Figure 1B:
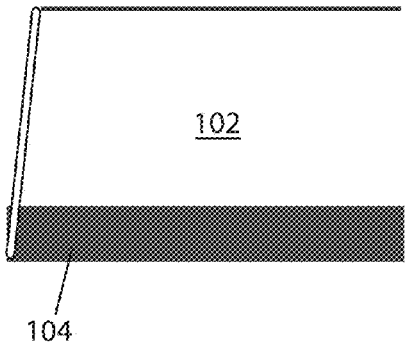
FIG. 1*b* is a large-scale cross-sectional view along section line 1-1 of FIG. 1*a*, in accordance with a first embodiment of the embodiment shown in FIG. 1*a*.
Figure 1C:
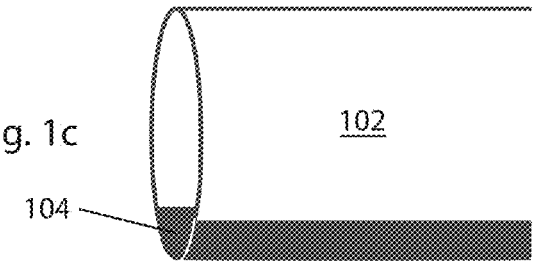
FIG. 1*c* is a large-scale cross-sectional view along section line 1-1 of FIG. 1*a*, in accordance with a second embodiment of the embodiment shown in FIG. 1*a*.

As shown in FIGS. 1*b* and 1*c*, which are large-scale cross-sectional views along section line 1-1 of FIG. 1*a*, sweat control device 100 may be made from a single-layer of material (FIG. 1*b*) or a double-layer of material (FIG. 1*c*). In FIG. 1*b*, sweat control device 100 is a single-layer of moisture-conductive material 102, which is treated—with moisture-resistant coating 104—along a portion of the back surface and a portion of the front surface of its bottom edge.

In FIG. 1*c*, sweat control device 100 is a double-layer of moisture-conductive material 102. The double-layer may be formed from a moisture-conductive material shaped as an flat, elongated, hollow tube, or it may be formed from two strips of moisture-conductive material connected together along their long-edges and, thereby, forming an flat, elongated, hollow tube. The flat, elongated, hollow tube may be, in cross-section, either oval or round. In either embodiment, moisture-conductive material 102 is treated—with moisture-resistant coating 104—along a portion of the outside surface and a portion of the inside surface along its bottom edge.

In operation, as a wearer sweats, moisture-conductive material 102 attracts and controls the sweat via capillary action, that is, the tiny droplets of sweat wick along moisture-conductive material 102 which, in turn, breaks the surface tension of the sweat. Under the pull of capillary action, the droplets of sweat move through moisture-conductive material 102 and collect into the channel created by moisture-resistant coating 104 and spread out along the waterproof channel. As the droplets of sweat spread out, they move towards channel ends 106*a* and 106*b* (not shown). As the droplets of sweat reach channel ends 106*a* and 106*b* (not shown), the untreated portion of moisture-conductive material 102 releases these droplets of sweat, transferring and discharging them down the back of wearer's neck, down the back of wearer's scalp, or into the back of the wearer's hair which, in turn, wicks them down the back of the wearer's neck.

As a person of ordinary skill in the art understands, the moisture-conductive material described herein may be any woven material—that is, a material having small spaces or creases for attracting the droplets of sweat—including, but not limited to, nylon, polypropylene, spandex, rayon, wool, merino wool, and silk. The thickness of the moisture-conductive material may vary in accordance with the application and environment. However, because the moisture-conductive material allows for the control and movement of the droplets of sweat (as opposed to the absorption and containment of the droplets of sweat), the moisture-conductive material may be as thin as a single-ply of material.

As a person of ordinary skill in the art further understands, the moisture-resistant coating described herein may be formed by treating the moisture-conductive material with any waterproof material, including, but not limited to, rubber, polyvinyl chloride, polyurethane, silicone elastomer, fluoropolymers, and wax. The coating process includes, but is not limited to, lamination, silk-screening, spraying, and printing.

In an alternate embodiment, the moisture-conductive material may be attached to a moisture-resistant material (as opposed to treated with a moisture-resistant coating). The means of attachment may be any conventional means for attaching two or more pieces of textiles together, including, but not limited to, sewing, gluing, binding, weaving, and braiding.

Figure 2A:
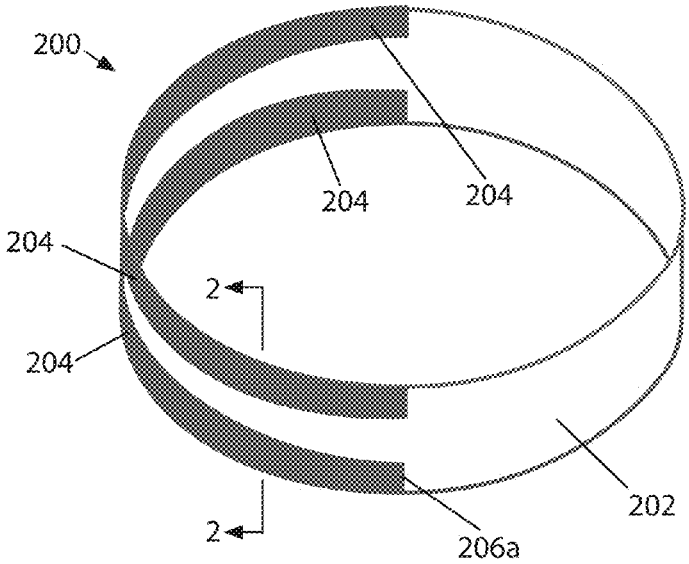
FIG. 2*a* is a top-down view of a sweat control device, in accordance with another embodiment of the invention.

FIG. 2*a* is a top-down view of a sweat control device, detached from any headgear, in accordance with another embodiment of the invention. In this embodiment, sweat control device 200 comprises moisture-conductive material 202, which is treated—with moisture-resistant coating 204—along a portion of the back surface and a portion of the front surface of both its bottom edge and top edge. In this embodiment, sweat control device 200 is both reversible and invertible, that is, it is may be worn "inside out," "outside in," "top side up," "top side down," or any one of the numerous combinations of reversible and invertible.

Figure 2B:
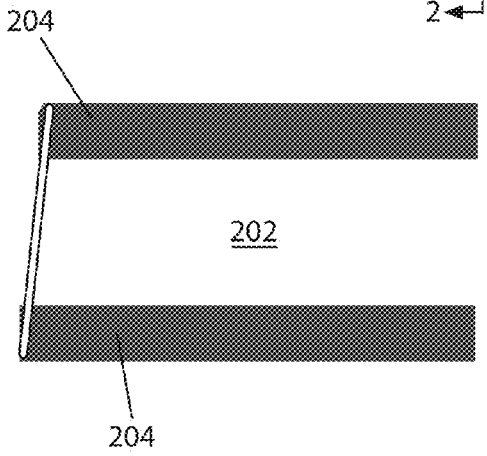
FIG. 2*b* is a large-scale cross-sectional view along section line 2-2 of FIG. 2*a*, in accordance with a first embodiment of the embodiment shown in FIG. 2*a*.
Figure 2C:
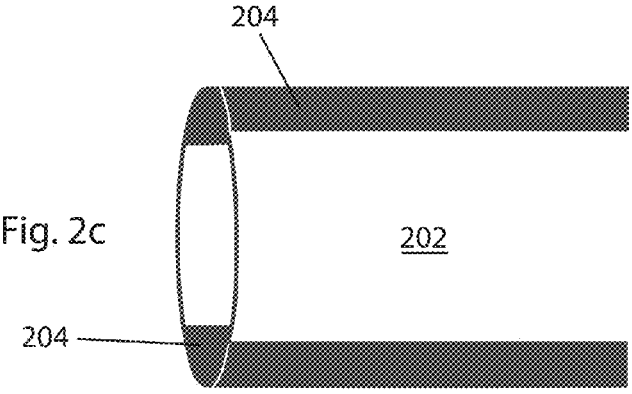
FIG. 2*c* is a large-scale cross-sectional view along dashed line 2-2 of FIG. 2*a*, in accordance with a second embodiment of the embodiment shown in FIG. 2*a*.

As shown in FIGS. 2*b* and 2*c*, which are large-scale cross-sectional views along section line 2-2 of FIG. 2*a*, sweat control device 200 may be made from a single-layer of material (FIG. 2*a*) or a double-layer of material (FIG. 2*b*). In FIG. 2*b*, sweat control device 200 is a single-layer of moisture-conductive material 202 that is treated—with moisture-resistant coating 204—along a portion of the back surface and a portion of the front surface of both its bottom edge and top edge. In FIG. 2*c*, sweat control device 200 is a double-layer of moisture-conductive material 202 that is treated—with moisture-resistant coating 204—along a portion of the outside surface and a portion of the inside surface along both its bottom edge and top edge.

In an alternate embodiment, the moisture-conductive material may be attached to a moisture-resistant material (as opposed to treated with a moisture-resistant coating). The means of attachment may be any conventional means for attaching two or more pieces of textiles together, including, but not limited to, sewing, gluing, binding, weaving, and braiding.

Figure 3A:
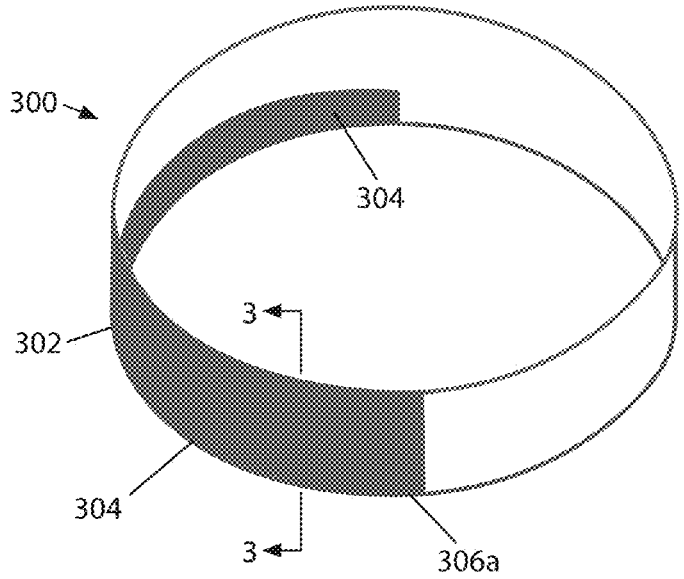
FIG. 3*a* is a top down view of a sweat control device, in accordance with still another embodiment of the invention.

FIG. 3*a* is a top-down view of a sweat control device, detached from any headgear, in accordance with still another embodiment of the invention. Sweat control device 300 comprises moisture-conductive material 302, which is treated—with moisture-resistant coating 304—along a portion of the front surface from its top edge to its bottom edge, and a portion of the back surface of its bottom edge.

Figure 3B:
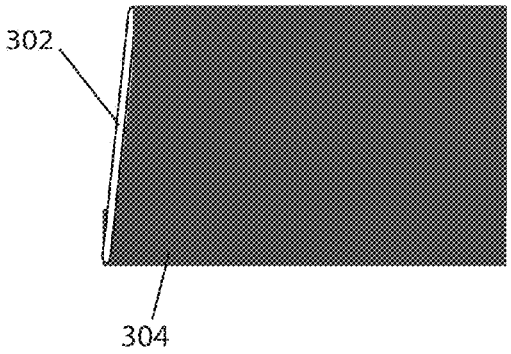
FIG. 3*b* is a large-scale cross-sectional view along section line 3-3 of FIG. 3*a*, in accordance with the embodiment shown in FIG. 3*a*.

As shown in FIG. 3*b*, which is a large-scale cross-sectional view along section line 3-3 of FIG. 3*a*, sweat control device 300 may be made from a single-layer of moisture-conductive material 302. The single-layer of moisture-conductive material 302 is treated—with moisture-resistant coating 304—along a portion of the front surface from its top edge to its bottom edge, and a portion of the back surface of its bottom edge.

In an alternate embodiment, the moisture-conductive material may be attached to a moisture-resistant material (as opposed to treated with a moisture-resistant coating). The means of attachment may be any conventional means for attaching two or more pieces of textiles together, including, but not limited to, sewing, gluing, binding, weaving, and braiding.

Figure 4:
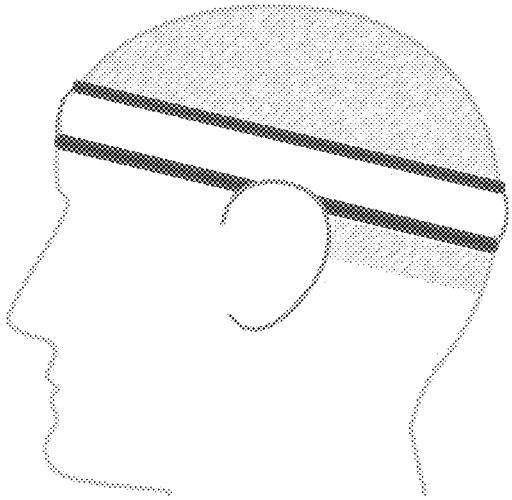
FIG. 4 is a side-view of the sweat control device shown in FIGS. 2*a*-2*c*, showing placement of the sweat control device on a wearer's head.
Figure 5:
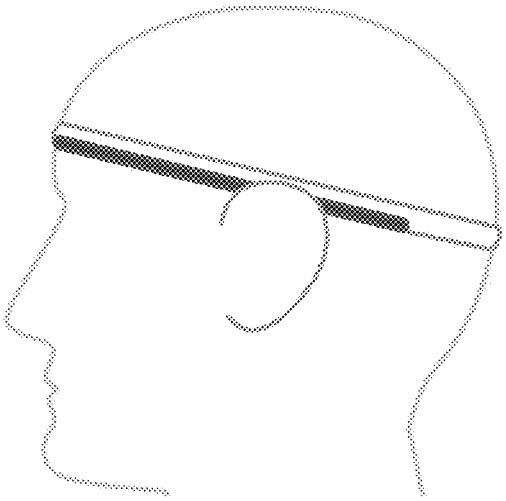
FIG. 5 is a side-view of the sweat control device shown in FIGS. 1*a*-1*c*, showing placement of the sweat control device on a wearer's head.

FIG. 4 is a side-view of the sweat control device shown in FIGS. 2*a*-2*c*, and FIG. 6 is a side-view of the sweat control device shown in FIGS. 1*a*-1*c*. The figures show the placement of their respective sweat control devices on a wearer's head. Further, the sweat control device may be designed as a head wrap, that is, as a band that is tied around a wearer's head.

In each of the described embodiments, the height of the moisture-resistant coating may be as short as $1/50^{th}$ (one-fiftieth) the height of the moisture-conductive material, or as tall as the full height of the moisture-conductive material. Further, the height of the moisture-resistant coating on the front surface of the moisture-conductive material may be the same as, shorter than, or taller than the height of the moisture-resistant coating on the back surface of the moisture-conductive material. In an embodiment in which the moisture-resistant coating on both the front and back surface of the moisture-conductive material is as tall as the full height of the moisture-conductive material, the top edge of the moisture-conductive material should remain exposed to the wearer's head.

In each of the described embodiments, the height of the moisture-conductive material may vary in accordance with the application and environment. In general, the shorter the height of the moisture-conductive material, the less capacity the moisture-conductive material has to attract and control the droplets of sweat.

In each of the described embodiments, the length of the moisture-resistant coating should be long enough to ensure that the droplets of sweat fall behind the wearer's ear. Typically, this is approximately ⅔ (two-thirds) the length of the moisture-conductive material. In an alternate embodiment, the moisture-resistant coating may extend for the full length of the moisture-conductive material. In this embodiment, the moisture-conductive material releases the droplets of sweat into the back of the wearer's hair which, in turn, wicks them down the back of the wearer's neck.

Although various exemplary embodiments of the invention have been disclosed, it should be apparent to those skilled in the art that various changes and modifications can be made which will achieve some of the advantages of the invention without departing from the true scope of the invention. The appended claims are intended to cover these and other obvious modifications.

I claim:

1. A sweat control device comprising:

a strip of material shaped as an elongated rectangle and configured to fit around at least a portion of the head of a wearer or at least a portion of the inside rim of a piece of headgear, the strip of material comprising a first side section, a middle section, and a second side section, the middle section having a front, a back and a bottom edge; the strip of material comprising moisture-conductive material for attracting and controlling moisture through capillary action; and a channel, the channel formed by a moisture-resistant coating to at least a portion of the front, the back and the bottom edge of the middle section of the strip of material, the channel collecting and routing the moisture from at least the middle section of the strip of material towards a first side edge and a second side edge of the channel.

2. The sweat control device according to claim 1 in which at least a portion of the channel attaches to at least a portion of the middle section of the strip of material using a process for coating textiles.

3. The sweat control device according to claim 1 in which the height of the front of the channel is shorter than, the same as, or taller than the height of the back of the channel.

4. The sweat control device according to claim 1 in which the height of the front of the channel is the same height as the strip of material.

5. The sweat control device of claim 1 in which the strip of material comprises a single-ply of material.

6. The sweat control device according to claim 1 in which at least a portion of the channel is sewed, glued, bound, weaved or braided to at least a portion of the middle section of the strip of material.

7. An invertible sweat control device comprising:

a strip of material shaped as an elongated rectangle and configured to fit around at least a portion of the head of a wearer or at least a portion of the inside rim of a piece of headgear, the strip of material comprising a first side section, a middle section, and a second side section, the middle section having a front, a back, a top edge, and a bottom edge; the first strip of material comprising moisture-conductive material for attracting and controlling moisture through capillary action;

a first channel, the first channel formed by a first moisture-resistant coating to at least a portion of the front, the back and the bottom edge of the middle section of the strip of material, the first channel collecting and routing the moisture from at least the middle section of the strip of material towards a first side edge and a second side edge of the first channel; and a second channel, the second channel formed by a second moisture-resistant coating to at least a portion of the front, the back and the top edge of the middle section of the strip of material, the second channel collecting and routing the moisture from at least the middle section of the strip of material towards a first side edge and a second side edge of the second channel when the sweat control device is inverted.

8. The invertible sweat control device according to claim 7 in which the first channel and the second channel attach to at least a portion of the middle section of the strip of material using a process for coating textiles.

9. The sweat control device according to claim 7 in which the height of the front of the first channel is shorter than, the same as, or taller than the height of the back of the first channel.

10. The sweat control device according to claim 7 in which the height of the front of the second channel is shorter than, the same as, or taller than the height of the back of the second channel.

11. The sweat control device of claim 7 in which the strip of material comprises a single-ply of material.

12. The invertible sweat control device according to claim 7 in which the first channel and the second channel are sewed, glued, bound, weaved or braided to at least a portion of the middle section of the strip of material.

13. A sweat control device comprising:

a strip of material shaped as an elongated rectangle and configured to fit around at least a portion of the head of a wearer or at least a portion of the inside rim of a piece of headgear, the strip of material comprising a single-ply of material and having a first side section, a middle section, and a second side section, the middle section having a front, a back and a bottom edge; the first strip of material comprising moisture-conductive material for attracting and controlling moisture through capillary action; and a channel, the channel formed by a moisture-resistant coating to at least a portion of the front, the back and the bottom edge of the middle section of the strip of material, the channel collecting and routing the moisture from at least the middle section of the strip of material towards a first side edge and a second side edge of the channel.

14. The sweat control device according to claim 13 in which the height of the front of the channel is shorter than, the same as, or taller than the height of the back of the channel.

15. The sweat control device according to claim 13 in which the height of the front of the channel is the same height as the strip of material.

16. The sweat control device according to claim 13 in which at least a portion of the channel is sewed, glued, bound, weaved or braided to at least a portion of the middle section of the strip of material.

* * * * *